US006108943A

United States Patent [19]

Hudson et al.

[11] Patent Number: 6,108,943

[45] Date of Patent: Aug. 29, 2000

[54] ARTICLE OF FOOTWEAR HAVING MEDIAL AND LATERAL SIDES WITH DIFFERING CHARACTERISTICS

[75] Inventors: Peter A. Hudson; Kaia Histand, both of Portland; Jeffrey C. Pisciotta, Oregon City, all of Oreg.

[73] Assignee: Nike, Inc., Beaverton, Oreg.

[21] Appl. No.: 09/016,295

[22] Filed: Jan. 30, 1998

[51] Int. Cl.[7] ..... A43B 1/10; A43B 23/00; A43B 13/00; A43B 5/00; A43B 13/14

[52] U.S. Cl. ..... 36/102; 36/45; 36/103; 36/108; 36/114; 36/25 R; 36/31; 36/32 R; 36/149

[58] Field of Search ..... 36/45, 56, 50.1, 36/91, 102, 103, 108, 114, 115, 3 A, 25 R, 28, 30 R, 31, 32 R, 145, 148, 149, 89, 144

[56] References Cited

U.S. PATENT DOCUMENTS

| | | | |
|---|---|---|---|
| D. 257,799 | 1/1981 | Combaret . | |
| D. 380,889 | 7/1997 | Earle . | |
| 4,045,888 | 9/1977 | Oxenberg | 36/114 |
| 4,241,524 | 12/1980 | Sink . | |
| 4,262,435 | 4/1981 | Block et al. . | |
| 4,316,334 | 2/1982 | Hunt . | |
| 4,354,319 | 10/1982 | Block et al. . | |
| 4,364,189 | 12/1982 | Bates . | |
| 4,389,798 | 6/1983 | Tilles . | |
| 4,439,936 | 4/1984 | Clarke et al. . | |
| 4,501,077 | 2/1985 | Young . | |
| 4,559,723 | 12/1985 | Hamy et al. . | |
| 4,559,724 | 12/1985 | Norton . | |
| 4,562,651 | 1/1986 | Frederick et al. . | |
| 4,615,126 | 10/1986 | Mathews . | |
| 4,685,227 | 8/1987 | Simmons | 36/127 |
| 4,694,591 | 9/1987 | Banich et al. . | |
| 4,730,402 | 3/1988 | Norton et al. | 36/30 R |
| 4,798,010 | 1/1989 | Sugiyama | 36/25 R |
| 4,876,806 | 10/1989 | Robinson et al. . | |
| 5,024,007 | 6/1991 | DuFour | 36/127 |
| 5,048,203 | 9/1991 | Kling . | |
| 5,319,866 | 6/1994 | Foley et al. | 36/103 |
| 5,371,957 | 12/1994 | Gaudio | 36/50.1 |
| 5,377,430 | 1/1995 | Hatfield et al. | 36/50.1 |
| 5,384,973 | 1/1995 | Lyden . | |
| 5,425,184 | 6/1995 | Lyden et al. . | |
| 5,625,964 | 5/1997 | Lyden et al. . | |
| 5,784,808 | 7/1998 | Hockerson | 36/102 |

FOREIGN PATENT DOCUMENTS

| | | | |
|---|---|---|---|
| 0 092 366 A1 | 10/1983 | European Pat. Off. . | |
| 411330 | 2/1991 | European Pat. Off. | 36/28 |
| 0 878 142 A1 | 11/1998 | European Pat. Off. . | |
| 2489104 | 3/1982 | France | 36/114 |
| 2516762 | 5/1983 | France | 36/50.1 |
| 1 188 475 | 3/1965 | Germany . | |
| 2751146 | 5/1979 | Germany | 36/31 |
| 3804441 | 8/1989 | Germany | 36/31 |
| 4018518 | 1/1991 | Germany | 36/103 |
| 57-32723 | 7/1982 | Japan . | |
| B5-9120 | 5/1985 | Japan . | |
| 1 395 680 | 5/1975 | United Kingdom . | |
| 2226746 | 7/1990 | United Kingdom | 36/103 |
| WO 91/05491 | 5/1991 | WIPO . | |
| 91/11924 | 8/1991 | WIPO | 36/28 |
| 91/19429 | 12/1991 | WIPO | 36/25 R |

*Primary Examiner*—Paul T. Sewell
*Assistant Examiner*—Anthony Stashick
*Attorney, Agent, or Firm*—Banner & Witcoff, Ltd.

[57] ABSTRACT

An improved article of footwear, specifically for use in the sport of tennis. The article of footwear addresses motions prevalent in the sport of tennis by enhancing performance and preventing injuries. The article of footwear is asymmetrical and the lateral and medial portions have features to performs different functions to enhance flexibility, balance control, propulsion, stability and support in the specific areas where needed. In part, the medial portion of the article of footwear is designed to provide flexibility while the lateral portion is designed to create stability. These differences in the medial and lateral portions of the article of footwear exist in the upper, e.g., lacing system, material composition, and material thickness differences, and/or in the sole, e.g., different midsole materials, supporting elements effecting only the lateral side.

26 Claims, 11 Drawing Sheets

ARTICLE OF FOOTWEAR HAVING MEDIAL AND LATERAL SIDES WITH DIFFERING CHARACTERISTICS

FIELD OF THE INVENTION

This invention relates to an article of footwear. More specifically, the invention relates to an article of footwear designed to address motions prevalent in the sport of tennis by enhancing performance and preventing injuries.

BACKGROUND OF THE INVENTION

Athletic shoes normally include a sole for providing traction and cushioning, and an upper for holding the foot of the wearer to the sole. The soles ordinarily have a multi-layer construction comprised of an outsole, a midsole and an insole. The outsole is normally formed of a durable material to resist wearing of the sole during use. The midsole ordinarily forms the middle layer of the sole and is typically composed of a soft foam material to cushion the impact forces and pressure experienced by the foot during athletic activities. The material used for the foam midsole typically has a Shore A hardness of approximately 55–60. The foam midsole may be formed with or without the inclusion of other cushioning elements, such as a resilient inflated bladder. An insole layer is usually a thin padded member provided overtop of the midsole to enhance the comfort afforded to the wearer.

Most shoes, including athletic shoes, are designed so that the medial side and the lateral side of the shoe are symmetric. This includes shoes designed for the sport of tennis which are routinely symmetrically designed. However, such designs do not take into account the demands and requirements of the sport as they relate to the performance and safety of the tennis player. For example, motions prevalent in tennis footwork create instability leading to fatigue, injury and inefficiency of footwork action. Accordingly, an article of footwear for use in the sport of tennis that maximizes performance and minimizes injury was thus needed. Additionally, U.S. Pat. No. 4,694,591 discloses a split midsole design. However, such a design would be unsuitable for the sport of tennis due to the typical movements involved.

In most prior art shoes, the outsole includes flex grooves that are either (a) straight across the sole, i.e., they are transverse to the longitudinal axis of the shoe and the foot of the wearer or (b) angled by a curve created by the metatarsal heads, see, e.g., U.S. Pat. No. 4,559,724. However, the grooves in these directions may be undesirable in some sports, for example tennis, where these groove are designed to flex in a direction generally opposite of the direction of many movements.

SUMMARY OF THE INVENTION

It is therefore an object of the present invention to provide an article of footwear that overcomes deficiencies in the prior art shoes, particularly those that have existed in prior art shoes intended for the sport of tennis.

It is another object of the present invention to consider the forces applicable to the different areas of the shoe, and to provide different designs for the lateral and medial portions of the shoe, on both the sole and the upper, in order to enhance flexibility, balance control, propulsion, stability and support in the specific areas where needed. This, in turn, provides improved performance and minimize injuries.

Additional objects of the present invention will be evident from the drawings and the written description below.

DETAILED DESCRIPTION OF THE PREFERRED EMBODIMENT

Figure 1:
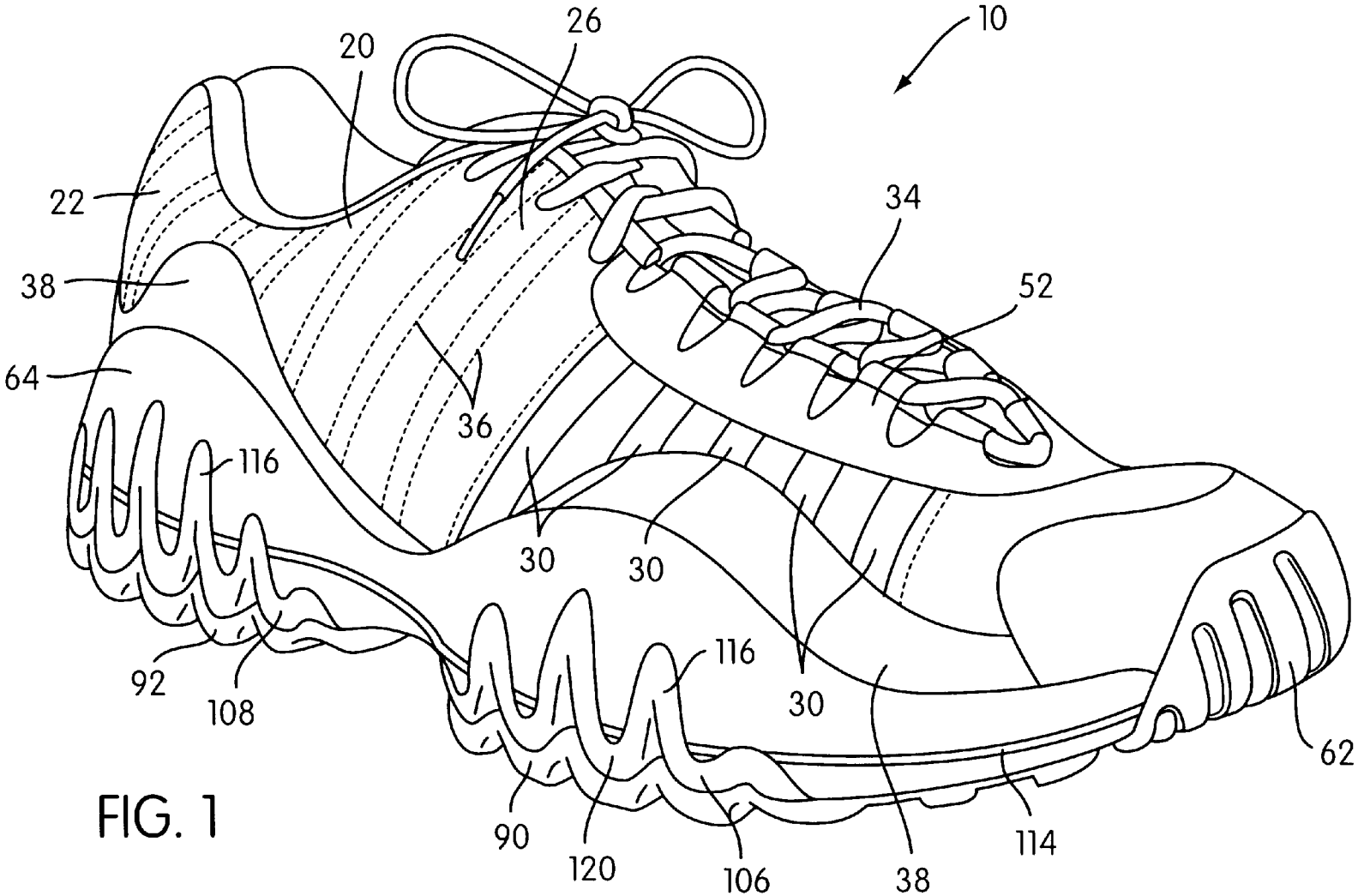
FIG. 1 is a front lateral perspective view of the article of footwear of the present invention.
Figure 2:
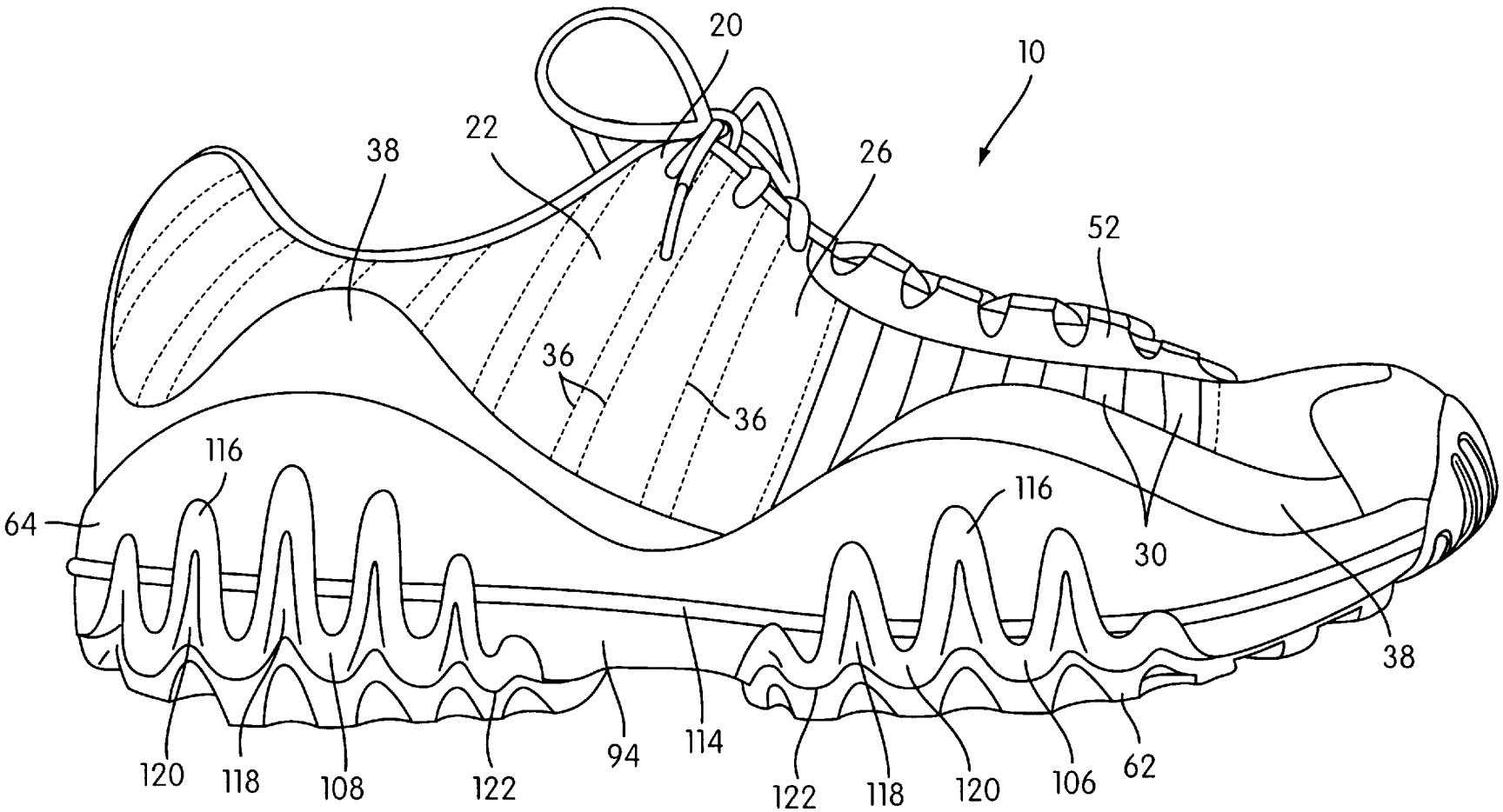
FIG. 2 is a lateral side elevational view thereof.
Figure 3:
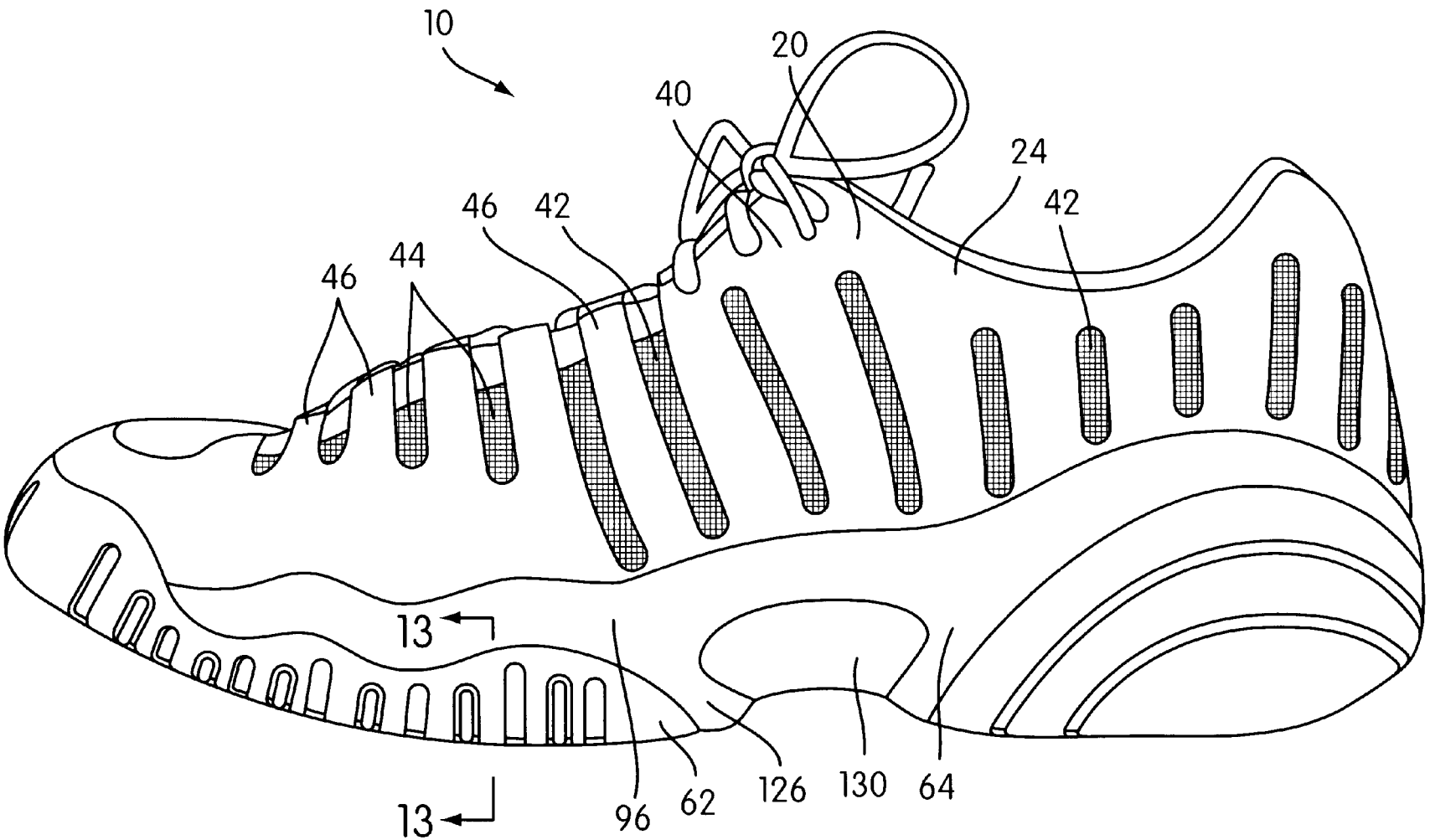
FIG. 3 is a medial side elevational view thereof.
Figure 4:
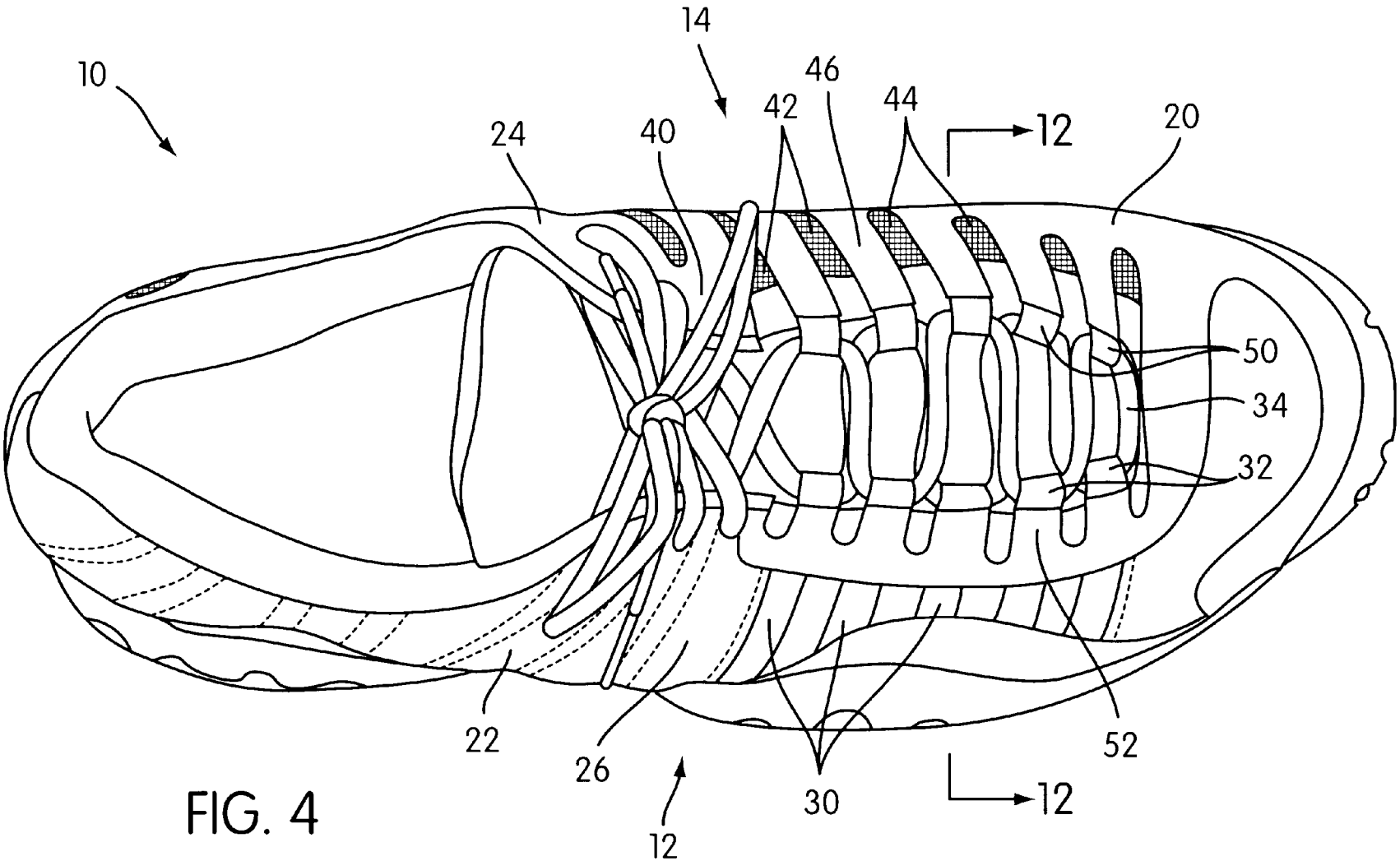
FIG. 4 is a top plan view thereof.
Figure 5:
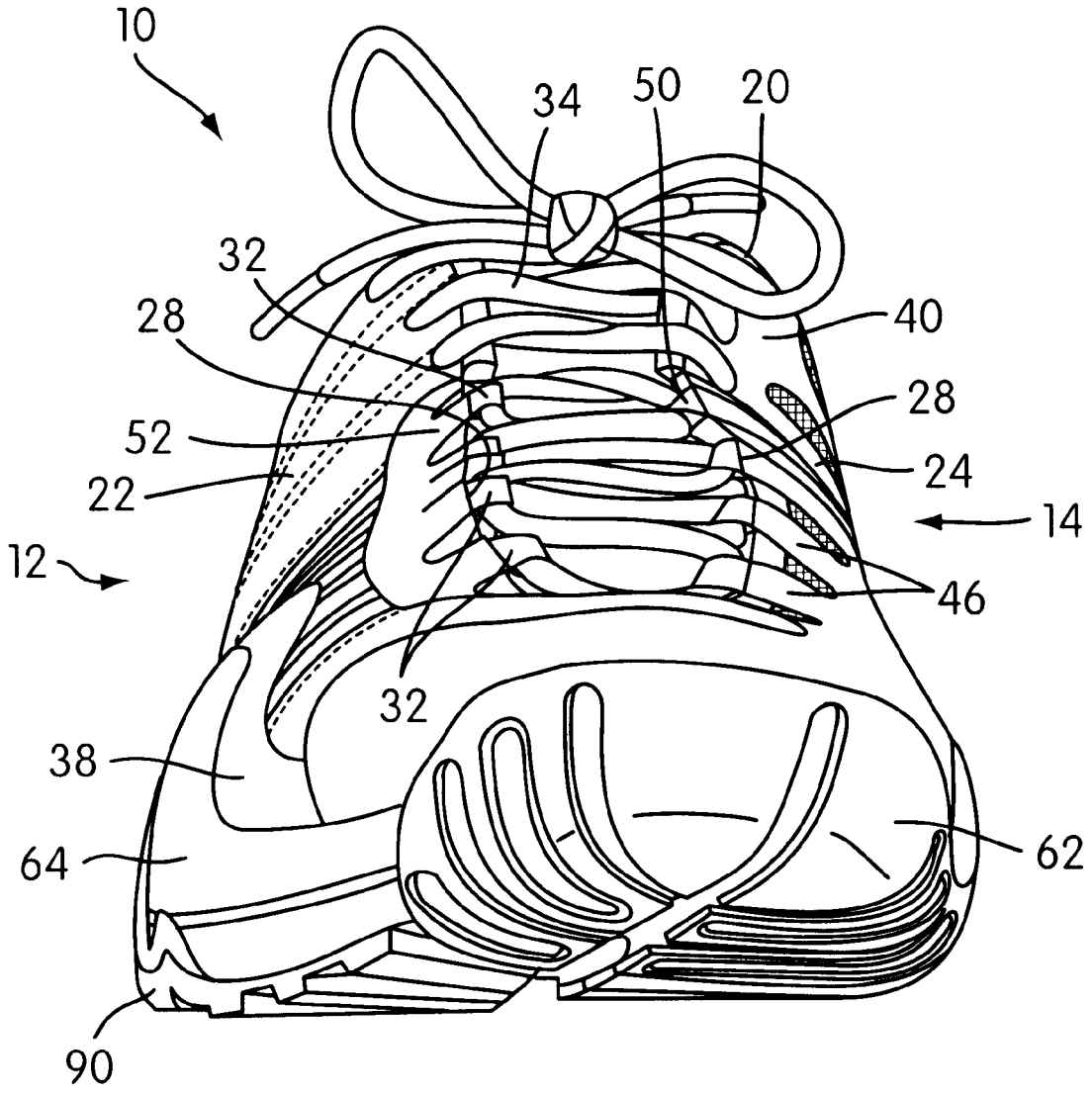
FIG. 5 is a front elevational view thereof.

An improved article of footwear, e.g., a shoe, is shown in FIGS. 1–13 and is designated generally by reference numeral 10. As will be evident from the description below, the shoe 10 is intended to enhance performance in, and prevent injuries associated with, the sport of tennis. In sum, to accomplish this, the design of the shoe 10 is basically made up of two halves, a lateral half 12 and a medial half 14, both of which have to perform very different actions. This medial-lateral division exists throughout the shoe 10, including the upper 20 and the sole 60 that includes at least an outsole 62 and a midsole 64.

The upper 20 includes a lateral side 22 and a medial side 24, each designed to function differently. In essence, the medial side 24 is designed to be flexible and provide the wearer with a high degree of flexibility. The lateral side 22 of the upper 20 is designed to provide a high degree of support to the wearer's foot. The flexibility of medial side 24 will enhance "toe off" and other movements which are important concerns in the sport of tennis. For example, improving toe off is important for a tennis player when serving and charging for a ball. The stability provided by the lateral side 22 is important because it helps to hold and support lateral side of the wearer's foot during the high amount of lateral movement associated with tennis. Accordingly, the lateral side 22 is less flexible than the medial side 24.

The lateral side 22 of the upper 20 includes a side panel 26 that covers a majority of the lateral side of the upper between the midsole 64 and the throat region 28 of the upper 20. Lateral side panel 26 is preferably made from a light-weight breathable synthetic material having minimal stretch capability, and may be polyurethane. A plurality of straps 30, that may be made from nylon or another suitable material, are sewn or otherwise attached to the outside of the primary lateral side panel 26 to provide extra support in the forefoot region. The distal ends of the lateral straps 30 include lace loops 32 so that a shoelace 34 may be routed through loops 32 for tensioning the upper 20 around the wearer's foot as described hereinafter. Additionally, the lateral primary side panel 26 may include generally upwardly extending stitch stripes 36 to strengthen the panel 26 and provide further support on the lateral side of the upper 22. If desired, lower side panels 38 may be located on top of the primary lateral side panel 26 in the regions immediately above the midsole 64. The lower side panels 38 provide additional support and protect the upper 20, and are preferably made from a skid resistant material, e.g., ceraprene. Similar material may be added in the toe box region for protection.

The medial side 24 of the upper 20 includes a side panel 40 that covers preferably all of or at least a majority of the medial side of the upper between the midsole 64 and the throat region 28 of the upper 20. Medial side panel 24 is preferably made from a relatively flexible, durable, minimal stretch material, e.g., ceraprene, for providing the desired flexibility and drag protection. The desired flexibility on the medial side 24 is further accomplished by providing a plurality of generally vertical slots 42 in the primary medial panel 40, and by making the thickness of the material on the medial side panel 40 less than the thickness of the lateral side panel 26. The slots 42 in the primary medial side panel 40 permit the panel 40, and in turn permit the shoe 10, to flex and collapse like an accordion. This is particularly true in the forefoot region where the flexibility aids the tennis player when he is on his toes. Lightweight breathable mesh 44 is preferably used to fill the areas created by the slots 42.

In the forefoot region on the medial side 24, tightening bands 46 are created by the material of the side panel 40 remaining between the slots 42. A plurality of straps 48, that may be nylon or another suitable material, are sewn or otherwise attached to the inside of the primary medial side panel 40, and more specifically, to the inside of the tightening bands 46. The distal ends of the lateral straps 30 include lace loops 50 so that a lace 34 may be routed through loops 50 for tensioning the upper 20 around the wearer's foot.

Figure 12:
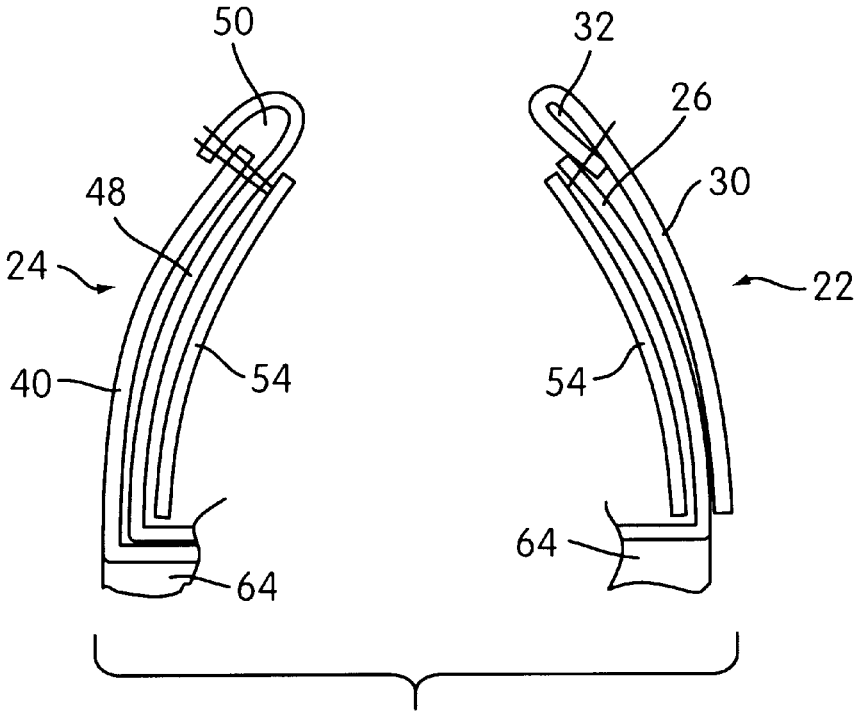
FIG. 12 is a partial cross-section taken through line 12—12 of FIG. 4.

As can be seen in FIG. 12, the lacing system differs between the lateral 22 and medial sides 24. When a shoelace 34 is routed through the lace loops 32 and 50 and tightened, it pulls differently on the lateral and medial sides of the upper 20 so that the medial side 24 remains flexible but snug, and the lateral side 22 securely holds down the wearer's foot and is less flexible when under pressure during a move. This benefit is further accentuated by the fact that the medial side panel 40 has slots 42 in it and the lateral side panel 26 is free of slots. The lack of slots on the lateral side panel 26 permits the disbursement of the tightening forces over the entire lateral side 22 to tightly secure the wearer's foot in the shoe without creating areas susceptible to irritation and fatigue. In contrast, the slots 42 on the medial side panel 40 causes the disbursement of the tightening forces on the medial side 24 over the regions with the tightening bands 46 to achieve both the desired flexibility and fit. A lacing strip 52 may be added over the top of the upper portion of the external lateral straps 30 to aid in the disbursement of forces over the side panel 26. A liner 54 may be used on the inside of both panels 26 and 40. This is especially desirable on the medial side 24 to reduce the possibility of irritation and fatigue.

Figure 6:
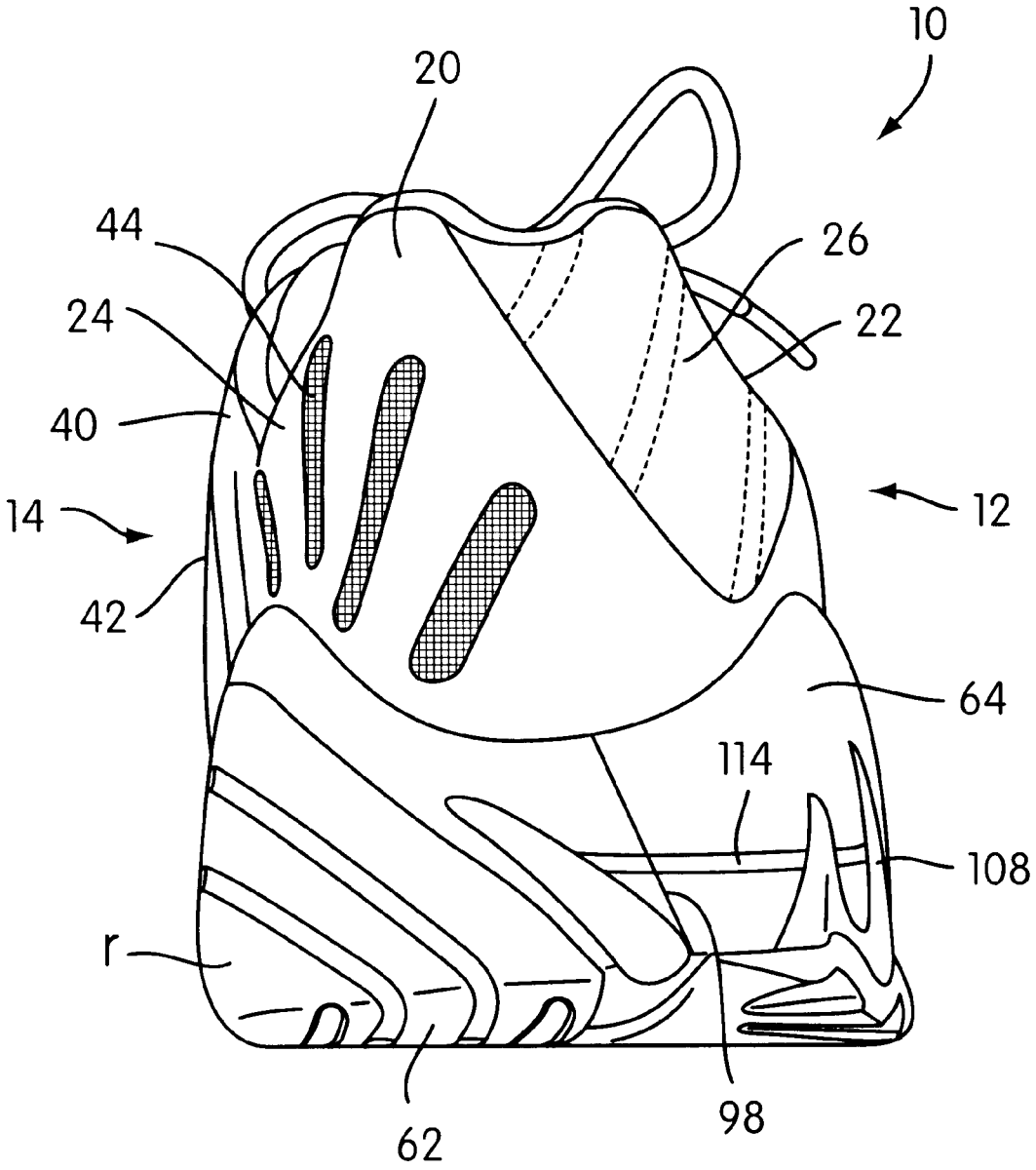
FIG. 6 is a rear elevational view thereof.
Figure 7:
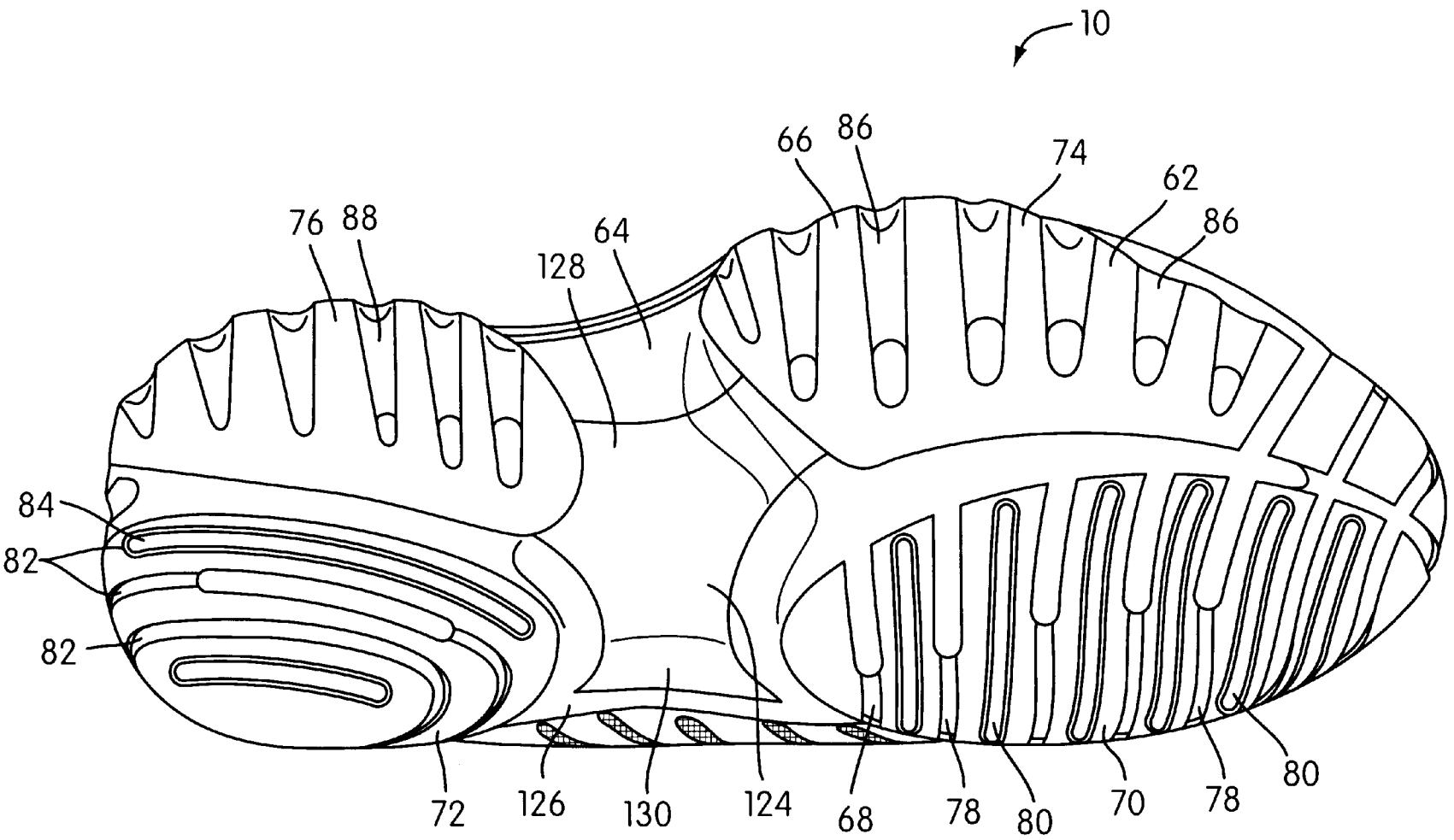
FIG. 7 is a bottom plan view thereof.
Figure 8:
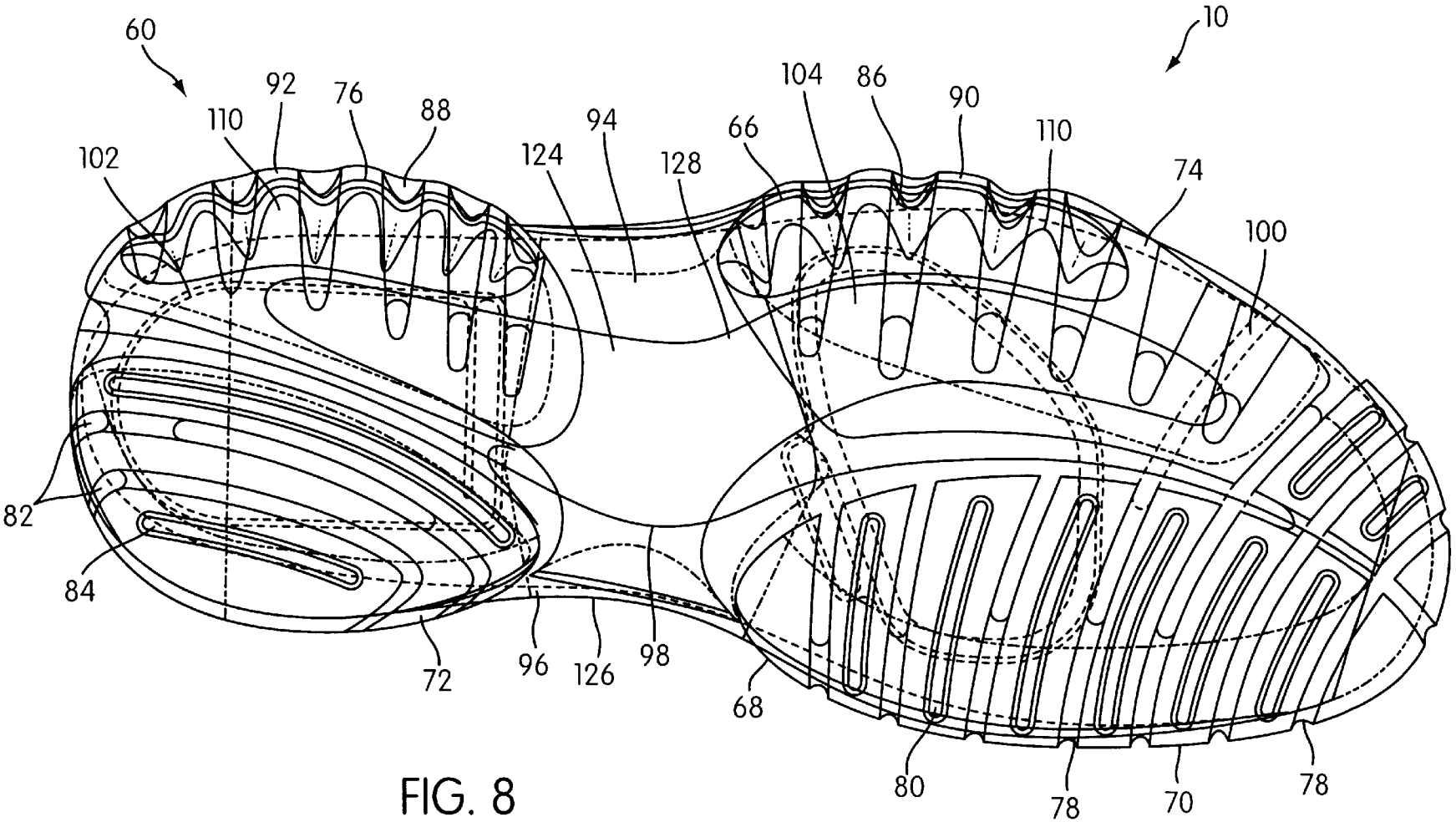
FIG. 8 is a bottom plan view of the sole unit including elements shown beneath the outer surface of the outsole.
Figure 9:
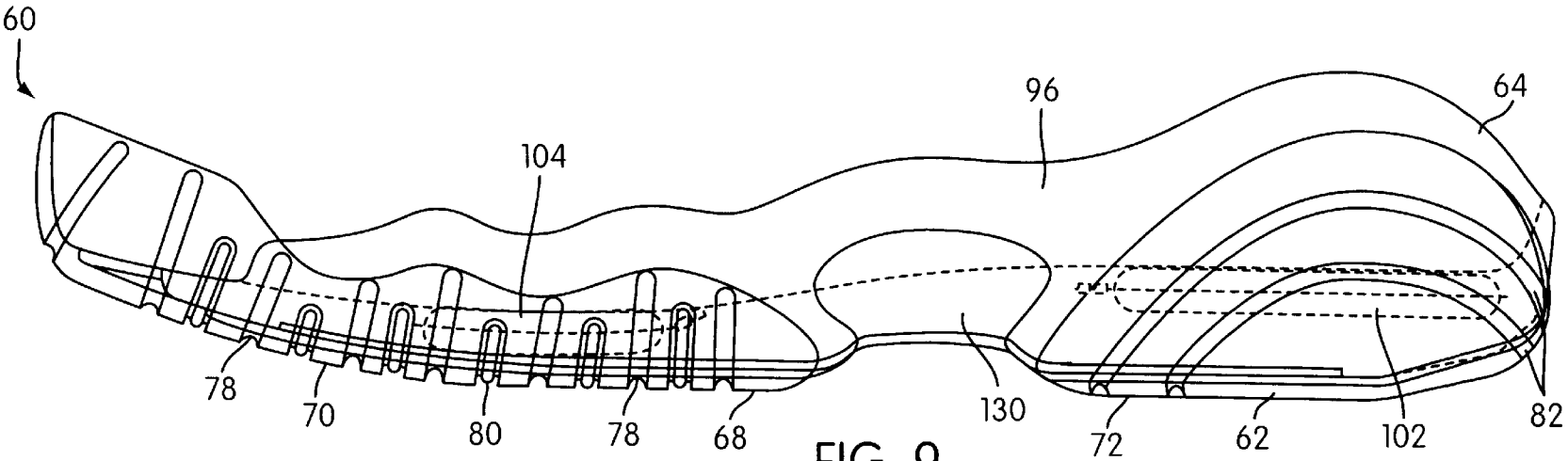
FIG. 9 is a medial side elevational view of the sole unit of FIG. 8.
Figure 10:
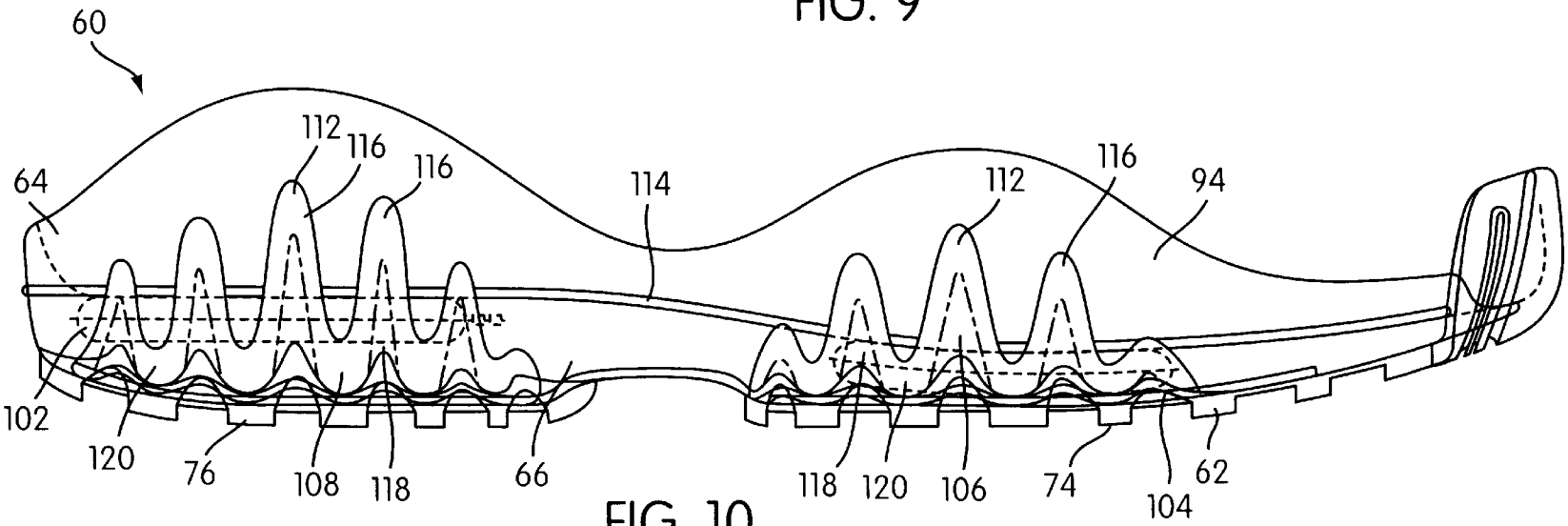
FIG. 10 is a lateral side elevational view of the sole unit of FIG. 8.
Figure 11:
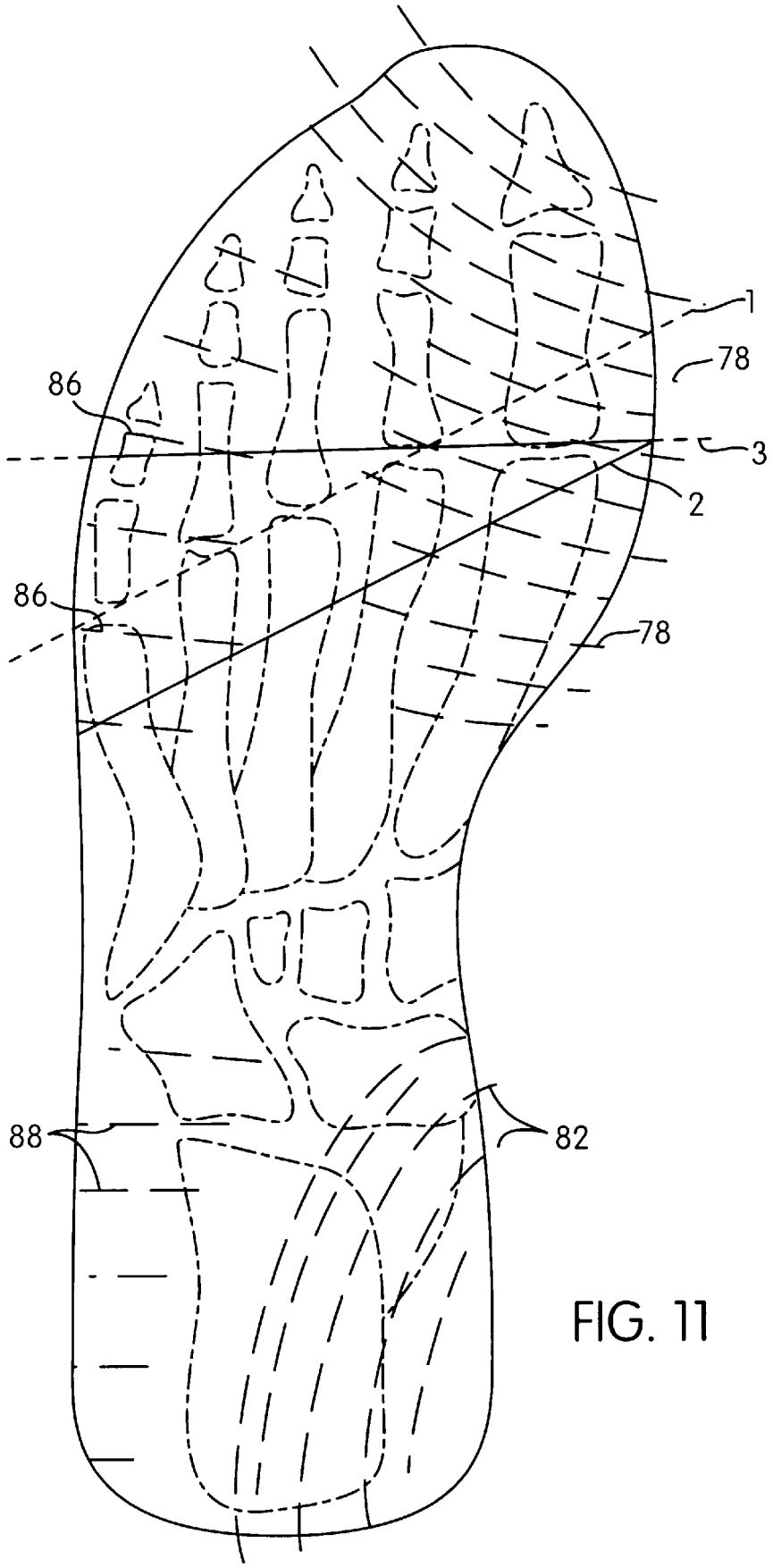
FIG. 11 is a bottom plan view illustrating the directional flex grooves in relation to the anatomy of a human foot.

As previously described, the shoe sole 60 includes an outsole 62 and a midsole 64. The outsole 62 is formed of a conventional durable material to resist wearing during use. As shown in FIGS. 6–8, the outsole 62 is substantially separated and divided into a lateral portion 66 and a medial portion 68, and each portion 66 and 68 is designed to behave differently. Outsole 62 generally includes a forefoot medial outsole element 70, a rearfoot medial outsole element 72, a forefoot lateral outsole element 74, and a rearfoot lateral outsole element 76.

Flex grooves are directional recesses in the sole material that enhance the ability of the sole to flex about the groove. The forefoot medial outsole element 70 includes a plurality of flex grooves 78 oriented to mimic the direction of many movements made in tennis. Except for the toe region, the flex grooves 78 do not extend all of the way across the sole because of the need to permit the different halves of the shoe to behave differently. The direction of flex grooves 78 is in direct contrast with most prior art shoes that have flex grooves 1, 2, 3 which extend transversely across the entire outsole or those that are in alignment with the metatarsals. The flex grooves 78 extend from the medial side edge transversely across the shoe and forwardly, i.e., towards the toe. This significantly improves the ability of the wearer to tow off. If desired, additional traction elements or strips 80 can be molded into some or all of the flex grooves 78. These traction strips 80 provide additional traction without sacrificing the desired flexibility.

In the very front of the outsole, the forefoot medial outsole element 70 has a portion that extends all the way across to the lateral side. The flex grooves 78 project right up to the very front of the foot in this portion, and in the front portion of the lateral side, to provide maximum power and traction across the entire toe region during toe off.

The rearfoot medial outsole element 72 extends upwardly a relatively large amount onto the side periphery of the sole 60. This provides protection in extreme circumstances when the foot happens to turn over. Rearfoot medial outsole element 72 has flex grooves 82 that encircle a region at the corner or edge of the rear medial side of the outsole. These grooves 82 enhance the ability of the rearfoot medial portion of the sole to flex and compress, both upwardly laterally, which is important when the wearer lands on the rear medial corner of the shoe. This enhanced compression feature can help prevent injuries. If desired, additional traction elements 84 can be added in some of the flex grooves 82 in the bottom portion of the rearfoot medial outsole element 72. Additional details of the flex grooves and their relationship to other features, and details of other features are apparent from the figures.

Figure 13:
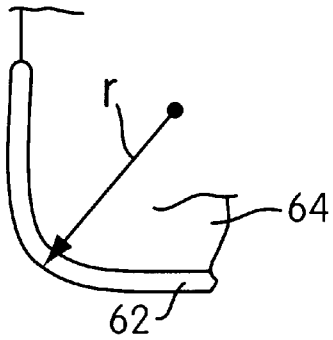
FIG. 13 is a partial cross-section taken through line 13—13 of FIG. 3.

Another advantage of the current design is the outer radius of the medial outsole where the bottom of the sole blends into the side periphery of the sole. Prior art designs typically include a medial sole radius in the range from 3–4 mm, in both the forefoot and heel regions. However, these prior art designs create instability during landing and inefficient take off due to this small medial sole radius. As schematically shown in FIG. 13, the present invention has a forefoot medial radius r as large as 16 mm, including the location where the front medial side of the sole is most likely to engage the ground. The forefoot medial radius r preferably gradually tapers in front of and behind this ground engaging portion to a radius of 6 mm. The rearfoot medial radius is as large as 18 mm, including at the location where the rear medial side of the sole is most likely to engage the ground, and may gradually vary to 6 mm in front of and behind this point. The medial outsole portions with the maximum radius of curvature may be the portions of the medial outsole at the widest forefoot and rearfoot portions so that these portions will most likely be the portions contacting the ground during purely lateral movement. By providing a significantly increased radius in these regions, the shoe permits the wearer to accomplish a smoother transition during landing and take off stages involved in the sport of tennis. In turn, this reduces the number of injuries and provides for more efficient power. In contrast to the radius of the medial outsole, the radius of curvature on the lateral side is preferably the same as or less than most prior art shoes, i.e., typically 3–4 mm.

Moreover, this increased medial radius has not been accomplished by increasing the thickness of the outsole material in these regions, as such would make the shoe less flexible and heavier. The present invention achieves the desired medial outsole radius by reducing the thickness of the midsole material in these regions to form the radius. For example, the midsole section may be 4 mm on the bottom and taper to 1.5 mm at its top to create this radius.

The forefoot and rearfoot lateral outsole elements 74 and 76 have flex grooves 86 and 88 respectively that are tapered in a manner to provide large lateral traction surfaces. This helps to provide additional stability during lateral or side-to-side moves—a movement that is frequently required in the sport of tennis. The shape of these flex grooves 86 and 88 adds the desired lateral traction in a manner to minimize weight and provide the desired flexibility. The forefoot and rearfoot lateral outsole elements 74 and 76 also extend laterally outward from the midsole 64 and do not wrap around the midsole 64 like the medial outsole elements 70 and 72. The outsole extends laterally from the midsole by about 1–2 mm. This extension forms outward extensions or overhangs 90 and 92 act as outriggers to prevent roll over and to enhance the wearer's ability to balance on the lateral edge.

The midsole 64 forms the middle layer of the sole 60 and includes of a soft foam material to cushion the impact forces and pressure experienced by the foot during athletic activities. This further enables the shoe 10 to perform in two distinct halves by addressing the requirements of each half and maximizing the individual benefits being provided to each. Accordingly, the midsole 64 is made of up distinctly performing lateral and medial portions 94 and 96. These portions 94 and 96 have different hardness/compression values to address the landing phase and support needs of the shoe. The lateral portion 94 is stiffer and less compressible than the medial portion 96 so that after the contact has been made by the medial portion of the shoe, and it transitions to the lateral side, the stiffer midsole supports the foot, preventing it from diving or rolling over by creating stability. The medial portion 96 is softer and more compressible than the lateral portion 94 so that during the landing process, the initial contact is slowed down, supportive and cushioned. Normally, in other prior art shoes, midsoles have a Shore A hardness of 55–60. In a preferred embodiment of the current invention, the softer medial portion 96 has a Shore A hardness of approximately 40, while the stiffer lateral portion 94 has a Shore A hardness of approximately 70. The split line 98 between the lateral and medial midsole portions 94 and 96 is best illustrated in FIGS. 6 and 7. This split line 98 preferably extends substantially longitudinally from the rear of the shoe to adjacent the front of the shoe to enable the benefits of the differential midsole cushioning effects to exist throughout substantially the entire shoe. It should be recognized that the midsole medial portion 96 with the softer cushioning effects substantially underlies the medial outsole elements 70 and 72 to enhance the flexibility of this region, while the midsole lateral portion 94 with the stiffer effects underlies the lateral outsole elements 74 and 76 to enhance the support and stability of this region. If desired, internal flex grooves 100 may be cut into the upper portion of the midsole in the direction of motion. These flex grooves may be aligned with the flex grooves 78 in the forefoot medial outsole element 70 to further allow the midsole to flex to create a better take off action.

If desired, front and rear cushioning elements, e.g., sealed gas-containing resilient bladders 102 and 104, can be added into the midsole material to provide additional cushioning. In a preferred embodiment, the rear bladder 104 is positioned directly below the calcaneous in the heel and the front bladder 102 is positioned below the ball of the foot. While the bladders 102, 104 may slightly inhibit flexibility, it may be beneficial to use the bladders 102 and 104 to add additional cushioning capabilities while still provide the features and benefits described above.

The sole 60 also includes forefoot and rearfoot lateral support devices 106 and 108. Each of these devices 106 and 108 have a horizontal portion 110 and a vertical portion 112. The horizontal portion 110 is embedded into the medial midsole portion 96 or attached between the lateral midsole portion 94 and the forefoot and rearfoot lateral outsole elements 74 and 76. The vertical portion 112 is curved to match the lateral profile of the midsole and the wearer's foot, and extends upwardly from the horizontal portion 110 to a height on the midsole above the footbed, as denoted by reference number 114.

One purpose of these lateral support elements 106 and 108 is to support the foot under severe lateral force. Many lateral or side-to-side movements cause the foot to slide over the footbed platform and roll over, This can cause severe injury to the athlete. The lateral holding elements 106, 108 hold the foot in the extreme lateral direction and prevents roll over injury. It also holds the midsole material in place in these regions to provide additional support. The forefoot lateral support element 106 is preferably positioned centrally to the fifth metatarsal head, while the rearfoot support element 108 is preferably positioned centrally to the calcaneous.

The lateral support elements 106 and 108 preferably include inverted v-shaped portions or fingers 116 that extend above the footbed line 114 to provide the holding force to the wearer's foot. The fingers 116 are stiff in the lateral direction for support, but are somewhat compliant for flexing in the forward direction by undulating shape. The lateral strength is accomplished in part by incorporating a strengthening indention 118 into each finger 116 to resist deflection in the lateral direction. The flexibility between the fingers 116 is provided in part by the curved section 120 between adjacent fingers 116. Additionally, the base of the lateral support elements 106 and 108 has an undulating bottom surface 122 that permits outsole material to flow into it during manufacturing to create a better bond therebetween. In a preferred arrangement, the lateral support elements 106 and 108 are injection molded polymer structures having an overall thickness of approximately 2 mm. However, it is recognized that the material, thickness, and method of manufacturing may be varied within the spirit of the invention.

The sole 60 also incorporates a stability shank 124 that couples the lateral half of the sole to the arch section 126 at the medial portion of the sole. The stability shank 124 is preferably a thin, lightweight, and rigid material, such as a carbon fiber or one of a number of plastics, that has its base or bottom portion 128 positioned on the lateral side between the lateral outsole elements 74 and 76 and the lateral midsole 94 and positioned at or near the bottom of the exposed midsole in the arch section 126. The stability shank 124 also includes a vertical arch wall portion 130 that extends upwardly in the arch section 126. Thus, on the lateral side, the stability shank 124 is elongated for stiffness, while the portion on the medial arch does not significantly increase the medial stiffness. The stability shank 124 transfers and/or balances forces between the medial arch section and the lateral forefoot and rearfoot section, and offers additional stability to the front and rear lateral portions.

In operation, the previously described features improve lateral stability and toe push off—both of which are important in tennis. Further, the shoe 10 reduces injury. These advantages are achieved by the differentiation of design in the medial and lateral portions of the shoe and the synergistic effects of the two portions.

While the various features of shoe 10 work together to achieve the advantages previously described, it is recognized that individual features and sub-combinations of these features can be used to obtain some of the aforementioned advantages without the necessity to adopt all of these features.

While particular embodiments of the invention have been shown and described, it is recognized that various modifications thereof will occur to those skilled in the art. Therefore, the scope of the herein-described invention shall be limited solely by the claims appended hereto.

What is claimed is:

1. An article of footwear, said article of footwear comprising:

a sole having a midsole and an outsole, said sole having and medial and lateral portions, said midsole being substantially longitudinally divided into medial and lateral portions, said outsole including a lateral outsole portion, and a medial outsole portion having front and rear portions, said rear medial outsold portion having a first region facing substantially downwardly and a second region facing substantially medially outwardly;

an upper, said upper coupled to the sole for retaining the foot of a wearer and including medial and lateral portions, a lateral side support panel on the lateral side of the upper, and a medial side support panel on the medial side of the upper;

a footbed surface positioned above at least a portion of the sole and below at least a portion of the upper, said footbed surface providing a surface upon which a foot of a wearer may rest;

means on the upper for making the medial portion of the upper more flexible than the lateral portion of the upper, said means on the upper for making the medial portion of the upper more flexible than the lateral portion of the upper includes a lacing system for tightly securing the a foot of a wearer to the sole within the upper, said lacing system including a plurality of lateral fastening straps and a plurality of medial fastening straps, each of said lateral fastening straps and said medial fastening straps having a distal upper end with a lace engaging element, said plurality of medial fastening straps being inside of said medial support panel and said plurality of lateral fastening straps being outside of said lateral support panel; and means on the sole for making the medial portion of the sole more flexible than the lateral portion of the sole, said means on the sole for making the medial portion of the sole more flexible than the lateral portion of the sole includes at least one of:

(a) differing midsole materials, such that said lateral portion of the midsole is formed from a first midsole material and said medial portion of the midsole is formed from a second midsole material, said first material being less compressible than said second material;

(b) a plurality of generally concentric medial flex grooves, said rear medial outsole portion having said plurality of generally concentric medial flex grooves located in the first and second regions of the rear medial outsole;

(c) a plurality of angled medial flex grooves, said medial outsole portion being separated from said lateral outsole portion and including said plurality of angled medial flex grooves that extend in a direction forwardly and laterally from the medial edge of the sole; and (d) front and rear lateral support elements, each of said lateral support elements being located on the lateral side of the sole and having a base portion and an upstanding portion, said base portion of each said lateral support element being positioned inside said sole below said footbed surface, and said upstanding portion of each lateral support surface extending above said footbed surface.

2. An article of footwear, said article of footwear having an upper and a sole, and medial and lateral portions on the upper and sole, said article of footwear comprising:

said upper including a lateral side panel covering a majority of the lateral side of the upper, and a medial side panel covering a majority of the medial side of the upper, said lateral side panel being made from a first material, and said medial side panel being made from a second material, said second material being more elastic than the first material making the medial portion of the upper more flexible than the lateral portion of the upper; and wherein the medial portion of the sole is more flexible than the lateral portion of the sole.

3. The article of footwear of claim 2, wherein said lateral side panel has a first thickness, and the medial side panel has a second thickness, said first thickness being greater than the second thickness.

4. The article of footwear of claim 3, wherein said medial side panel includes generally upwardly extending slots therein, and said lateral side panel is free of slots.

5. The article of footwear of claim 3, wherein said sole includes an outsole and a midsole, said midsole being divided longitudinally to form lateral and medial portions, said lateral portion of the midsole including a first midsole material and said medial portion of the midsole including a second midsole material, the first material being less compressible than the second material; and wherein the midsole has a forward end and a rearward end, and a line of demarcation is defined between the lateral and medial portions of the midsole, said line of demarcation extending substantially longitudinally from adjacent the forward end of the midsole to adjacent the rearward end of the midsole.

6. The article of footwear of claim 2, wherein said lateral side panel is made from polyurethane and said medial side panel is made from Ceraprene.

7. The article of footwear of claim 2, wherein said sole includes a medial arch portion, a lateral forefoot portion, and a lateral rearfoot portion, and a stiffening element extending from the medial arch portion of the sole to the lateral portion of the sole and extending between the lateral forefoot and rearfoot lateral portions, wherein the stiffening element includes a base, and a generally vertical section that extends upwardly from the base in the medial arch portion of the sole.

8. The article of footwear of claim 2, wherein said sole includes: an outsole and a midsole, said outsole including a medial bottom outsole portion, a lateral bottom outsole portion, a medial periphery outsole portion, and a lateral periphery outsole portion; a lateral radius defined generally by the approximate radius of curvature between the lateral bottom outsole portion and the lateral periphery outsole portion; a medial radius defined generally by the approximate radius of curvature between the medial bottom outsole portion and the medial periphery outsole portion; wherein the maximum lateral radius is not greater than 4 mm and the maximum medial radius is not less than 13 mm.

9. The article of footwear of claim 2, further comprising a lacing system for tightly securing the a foot of a wearer to the sole within the upper, said lacing system including a plurality of lateral fastening straps and a plurality of medial fastening straps, each of said lateral fastening straps and said medial fastening straps having a distal upper end with a lace engaging element, said plurality of medial fastening straps being inside of said medial side panel and said plurality of lateral fastening straps being outside of said lateral side panel.

10. An article of footwear, said article of footwear having an upper and a sole, and medial and lateral portions on the upper and sole, said article of footwear comprising:

said upper including a lateral side panel covering a majority of the lateral side of the upper, and a medial side panel covering a majority of the medial side of the upper, said lateral side panel having a first thickness, and a medial side panel having a second thickness, said first thickness being greater than the second thickness making the medial portion of the upper more flexible than the lateral portion of the upper; and wherein the medial portion of the sole is more flexible than the lateral portion of the sole.

11. The article of footwear of claim 10, wherein said medial side panel includes generally upwardly extending slots therein, and said lateral side panel is free of slots.

12. The article of footwear of claim 11, further comprising a lacing system for tightly securing the a foot of a wearer to the sole within the upper, said lacing system including a plurality of lateral fastening straps and a plurality of medial fastening straps, each of said lateral fastening straps and said medial fastening straps having a distal upper end with a lace engaging element, said plurality of medial fastening straps being inside of said medial side panel and said plurality of lateral fastening straps being outside of said lateral side panel.

13. The article of footwear of claim 10, wherein said lateral side panel being is made from a first material, and said medial side panel being made from a second material, said second material being more elastic than the first material, and wherein said medial side panel includes slots therein, and said lateral side panel is free of slots.

14. The article of footwear of claim 13, wherein said first material is polyurethane and said second material is Ceraprene.

15. The article of footwear of claim 10, wherein said sole includes a medial arch portion, a lateral forefoot portion, and a lateral rearfoot portion, and a stiffening element extending from the medial arch portion of the sole to the lateral portion of the sole and extending between the lateral forefoot and rearfoot lateral portions, wherein the stiffening element includes a base, and a generally vertical section that extends upwardly from the base in the medial arch portion of the sole.

16. The article of footwear of claim 10, wherein said sole includes an outsole and a midsole, said midsole being divided longitudinally to form lateral and medial portions, said lateral portion of the midsole including a first midsole material and said medial portion of the midsole including a second midsole material, the first material being less compressible than the second material; and wherein the midsole has a forward end and a rearward end, and a line of demarcation is defined between the lateral and medial portions of the midsole, said line of demarcation extending substantially longitudinally from adjacent the forward end of the midsole to adjacent the rearward end of the midsole.

17. The article of footwear of claim 10, wherein said sole includes: an outsole and a midsole, said outsole including a medial bottom outsole portion, a lateral bottom outsole portion, a medial periphery outsole portion, and a lateral periphery outsole portion; a lateral radius defined generally by the approximate radius of curvature between the lateral bottom outsole portion and the lateral periphery outsole portion; a medial radius defined generally by the approximate radius of curvature between the medial bottom outsole portion and the medial periphery outsole portion; wherein the maximum lateral radius is not greater than 5 mm and the maximum medial radius is not less than 10 mm.

18. An article of footwear, said article of footwear having an upper and a sole, and medial and lateral portions on the upper and sole, said article of footwear comprising:

said upper including a lateral side panel covering a majority of the lateral side of the upper, and a medial side panel covering a majority of the medial side of the upper, said medial side panel including generally upwardly extending slots therein, and said lateral side panel being free of slots therein making the medial portion of the upper more flexible than the lateral portion of the upper; and wherein the medial portion of the sole is more flexible than the lateral portion of the sole.

19. The article of footwear of claim 18, wherein said lateral side panel being is made from a first material, and said medial side panel being made from a second material, said second material being more elastic than the first material.

20. The article of footwear of claim 19, wherein said first material includes polyurethane and said medial side panel includes Ceraprene.

21. The article of footwear of claim 19, further comprising a lacing system for tightly securing the a foot of a wearer to the sole within the upper, said lacing system including a plurality of lateral fastening straps and a plurality of medial fastening straps, each of said lateral fastening straps and said medial fastening straps having a distal upper end with a lace engaging element, said plurality of medial fastening straps being inside of said medial side panel and said plurality of lateral fastening straps being outside of said lateral side panel.

22. The article of footwear of claim 19, wherein said sole includes: an outsole and a midsole, said outsole including a medial bottom outsole portion, a lateral bottom outsole portion, a medial periphery outsole portion, and a lateral periphery outsole portion; a lateral radius defined generally by the approximate radius of curvature between the lateral bottom outsole portion and the lateral periphery outsole portion; a medial radius defined generally by the approximate radius of curvature between the medial bottom outsole portion and the medial periphery outsole portion; wherein the maximum lateral radius is not greater than 5 mm and the maximum medial radius is not less than 6 mm.

23. The article of footwear of claim 22, wherein the maxims lateral radius is not greater than 4 mm and the maximum medial radius is not less than 10 mm.

24. The article of footwear of claim 22, wherein the maximum medial radius is not less than 13 mm.

25. The article of footwear of claim 18, wherein said sole includes an outsole and a midsole, said midsole being divided longitudinally to form lateral and medial portions, said lateral portion of the midsole including a first midsole material and said medial portion of the midsole including a second midsole material, the first material being less compressible than the second material; and wherein the midsole has a forward end and a rearward end, and a line of demarcation is defined between the lateral and medial portions of the midsole, said line of demarcation extending substantially longitudinally from adjacent the forward end of the midsole to adjacent the rearward end of the midsole.

26. The article of footwear of claim 25, wherein said lateral side panel is made from a first material, and said medial side panel is made from a second material, said second material being more elastic than the first material.

* * * * *

UNITED STATES PATENT AND TRADEMARK OFFICE

CERTIFICATE OF CORRECTION

PATENT NO. : 6,108,943
DATED : August 29, 2000
INVENTOR(S) : Peter A. Hudson, et al.

It is certified that error appears in the above-identified patent and that said Letters Patent is hereby corrected as shown below:

Column 7, claim 1,
Line 43, the first occurrence of "a" should be deleted.
Line 26, "outsold" should be replaced with -- outsole --.

Column 9, claim 12,
Line 32, the second occurrence of "a" should be deleted.

Column 10, claim 21,
Line 41, the second occurrence of "a" should be deleted.

Column 10, claim 23,
Line 64, "maxims" should be replace with -- maximum --.

Abstract,
Line 6, "performs" should be replaced with -- perform --.

Signed and Sealed this

Fourth Day of September, 2001

*Attest:*

Nicholas P. Godici

*Attesting Officer*

NICHOLAS P. GODICI
*Acting Director of the United States Patent and Trademark Office*